US006983491B2

(12) United States Patent
Curtis et al.

(10) Patent No.: US 6,983,491 B2
(45) Date of Patent: Jan. 10, 2006

(54) ODOR REMOVAL APPARATUS AND/OR METHODS

(76) Inventors: Gary Ian Curtis, 20 Tinopai Drive, Omokorea, Tauranga (NZ); Stephen James Mickleson, 11 Aaron Place, Tauranga (NZ)

( * ) Notice: Subject to any disclaimer, the term of this patent is extended or adjusted under 35 U.S.C. 154(b) by 44 days.

(21) Appl. No.: 10/427,927

(22) Filed: May 2, 2003

(65) Prior Publication Data

US 2003/0229937 A1 Dec. 18, 2003

(30) Foreign Application Priority Data

May 2, 2002 (NZ) ..... 518701

(51) Int. Cl.
*E03D 9/04* (2006.01)

(52) U.S. Cl. ..... 4/216; 4/213

(58) Field of Classification Search ..... 4/209 R, 4/213, 216, 219

See application file for complete search history.

(56) References Cited

U.S. PATENT DOCUMENTS

| | | | | | |
|---|---|---|---|---|---|
| 2,297,935 | A | * | 10/1942 | Baither | 4/213 |
| 2,985,890 | A | * | 5/1961 | Baither | 4/213 |
| 3,524,415 | A | | 8/1970 | Heiman | |
| 3,649,972 | A | | 3/1972 | Sowards | |
| 3,938,201 | A | | 2/1976 | McGrew | |
| 4,133,060 | A | | 1/1979 | Webb | |
| 4,365,361 | A | | 12/1982 | Sanstrom | |
| 4,800,596 | A | | 1/1989 | Menge | |
| 4,864,664 | A | * | 9/1989 | Higgins | 4/213 |
| 5,044,018 | A | | 9/1991 | Gandini | |
| 5,257,421 | A | | 11/1993 | Rose | |
| 6,370,703 | B1 | * | 4/2002 | Kim et al. | 4/216 |

FOREIGN PATENT DOCUMENTS

| | | |
|---|---|---|
| GB | 2 096 662 A | 10/1982 |
| GB | 2 184 140 A | 6/1987 |
| GB | 2 347 691 A | 9/2000 |

* cited by examiner

*Primary Examiner*—Tuan Nguyen
(74) *Attorney, Agent, or Firm*—Young & Thompson

(57) ABSTRACT

An odor removal apparatus for a toilet wherein the apparatus and toilet has a bowl, an outlet from the bowl and a barrier between the bowl and the outlet which substantially prevents odors from the outlet passing to the bowl. A gas extraction apparatus is in communication with an area in the vicinity of the bowl and the outlet whereby operation of the gas extraction apparatus substantially removes odors from the vicinity of the bowl and transfers them to the outlet. The gas extraction apparatus comprises a fan operable to induce a flow of gases and entrained odors for removal of the odors from the vicinity of a toilet. The fan is immersed in the water in the cistern of the toilet.

9 Claims, 10 Drawing Sheets

ODOR REMOVAL APPARATUS AND/OR METHODS

FIELD OF THE INVENTION

This invention relates to odour removal apparatus and methods. In particular, the invention relates to odour removal apparatus and methods for removing gases which include undesirable odours from the vicinity of a toilet or lavatory bowl. However, the invention is not limited to this application.

BACKGROUND OF THE INVENTION

Most known methods of odour removal for toilets use a fan or the like which is mounted on an exterior wall of the room in which the toilet is located. Such extraction fans are often operated when a user enters the room in which the toilet is located and turns on a light for example. A disadvantage of this known system is that odours must leave the toilet bowl and enter the room before they can be removed from the room. Thus the system really only prevents odours escaping from the room in which the toilet is located rather than removing odours before they enter the room.

The fan constrictions used in these known systems are also cumbersome, making them awkward and expensive to install. Furthermore, they do not have any control system that allows characteristics of the fan to be altered to improve efficiency, performance or to provide a user with a greater range of operating conditions. For example, the known systems are prone to be noisy which can be bothersome to many users and there is no provision for altering fan operating parameters, such as speed, to reduce the noise. Known fans are often left running for long periods of time, which is inefficient and reduces the life of the fan.

Wall and ceiling fan systems typically have limited back pressure capabilities limiting the distance over which the air can be expelled. They thus typically require at least 100 mm ducting. This is very inconvenient to install.

OBJECT OF THE INVENTION

It is an object of the present invention to provide odour removal apparatus and/or methods which will at least go some way toward overcoming the foregoing disadvantages or other disadvantages of known constructions, or which will at least provide the public with a useful choice.

SUMMARY OF THE INVENTION

Accordingly, in one aspect, the invention is an odour removal apparatus for a toilet, the toilet having a bowl an outlet from the bowl a barrier between the bowl and the outlet which substantially prevents odours from the outlet passing to the bowl, and a gases extraction means in communication with an area in the vicinity of the bowl and the outlet whereby operation of the gases extraction means substantially removes odours from the vicinity of the bowl and transfers them to the outlet.

Preferably the gases extraction means comprises a fan means operable to induce a flow of gases and entrained odours for removal of the odours from the vicinity of a toilet.

Preferably a flow control means is provided to substantially prevent odours flowing from the outlet to the bowl through the gases extraction means.

Preferably the flow control means is a one way valve.

In a further aspect the invention consists in a toilet or lavatory having a bowl an outlet from the bowl the bowl and outlet configured in use to be adapted to provide a substantially odour impermeable barrier, a gases delivery passageway provided in or adjacent to the bowl, and a gases receiving passageway provided in communication with the outlet.

Preferably a gases extraction means is in communication with an area in the vicinity of the bowl and the outlet whereby operation of the gases extraction means substantially removes odours from the vicinity of the bowl and transfers them to the outlet.

Preferably the gases extraction means comprises a fan means operable to induce a flow of gases and entrained odours for removal of the odours from the vicinity of a toilet.

Preferably the barrier comprises a water trap.

Preferably a flow control means is provided to substantially prevent odours flowing from the outlet to the bowl through the gases extraction means.

Preferably the flow control means is a one way valve.

Preferably the apparatus includes control means for controlling the operation of the fan means.

Preferably the control means includes flow rate selection means to allow a user to vary the rate of gases flow induced by the fan means.

Preferably the fan means includes a housing, a motor within the housing, an impeller provided within the housing and coupled to the motor so that operation of the motor imparts rotational energy to the impeller, an inlet provided in the housing adapted for attachment to a gas inlet conduit, an outlet provided in the housing adapted for attachment to a gas outlet conduit.

Preferably the width of the housing being not substantially greater than the width of the inlet or width of the outlet.

Alternatively the fan means includes a housing, a direct current motor within the housing, an impeller provided within the housing and coupled to the motor so that operation of the motor imparts rotational energy to the impeller, an inlet provided in the housing adapted for attachment to a gas inlet conduit, and an outlet provided in the housing adapted for attachment to a gas outlet conduit.

In a further aspect the invention broadly consists in some odour removal apparatus for a toilet, the toilet having a bowl an outlet from the bowl a barrier between the bowl and the outlet which substantially prevents odours from the outlet passing to the bowl, and a gas extraction means in communication with an overflow conduit in a cistern of the toilet and the gases extraction means being in communication with the outlet, whereby operation of the gases extraction means substantially removes odours from the bowl through the overflow conduit and transfers the gases to the outlet.

Preferably the gases extraction means comprises a fan means operable to induce a flow of gases and entrained odours for removal of the odours from the vicinity of a toilet.

Preferably a flow control means is provided to substantially prevent odours flowing from the outlet to the bowl through the gases extraction means.

Preferably the flow control means is a one way valve.

In yet a further aspect the invention consists in a toilet or lavatory having a bowl an outlet from the bowl the bowl and outlet configured in use to provide a substantially odour impermeable barrier a gases passageway being provided between the bowl and a cistern of the toilet, a gases extraction means in communication with the cistern and the outlet and a gases transfer region being provided within the cistern so as to provide communication between the passageway and the gases extraction means, and operation of the gases extraction means substantially removing odours from the vicinity of the bowl and transferring them to the outlet.

Preferably the gases extraction means comprises a fan means operable to induce a flow of gases and entrained odours for removal of the odours from the vicinity of a toilet.

Preferably a flow control means is provided to substantially prevent odours flowing from the outlet to the bowl through the gases extraction means.

Preferably the flow control means is a one way valve.

Preferably the gases transfer region comprises a compartment within the cistern which compartment creates a seal between the passageway and the gases extraction means using the presence of water within the cistern.

Alternatively the gases transfer region comprises the air space above the water level in the cistern.

In a further aspect the invention consists in a toilet or lavatory having a bowl an outlet from the bowl a bowl and outlet configured in use to be adapted to provide a substantially odour impermeable barrier a flushing inlet to in use receive water from a cistern, and a gases delivery passageway provided in or adjacent to the bowl and located in a region or the bowl remote from the flushing inlet.

Preferably a gases extraction means is in communication with the cistern and the outlet and a gases transfer region being provided within the cistern so as to provide communication between the passageway and the gases extraction means, and operation of the gases extraction means substantially removing odours from the vicinity of the bowl and transferring them to the outlet.

Preferably the gases extraction means comprises a fan means operable to induce a flow of gases and entrained odours for removal of the odours from the vicinity of a toilet.

Preferably a flow control means is provided to substantially prevent odours flowing from the outlet to the bowl through the gases extraction means.

Preferably the flow control means is a one way valve.

Preferably the passageway includes a region of sufficient dimension to include a gases extraction means therein.

In yet a further aspect the invention consists in a toilet or lavatory having walls adapted to conceal a gases extraction fan means.

To those skilled in the art to which the invention relates, many changes in construction and widely differing embodiments and applications of the invention will suggest themselves without departing from the scope of the invention as defined in the appended claims. The disclosures and the descriptions herein purely illustrative and are not intended to be in any sense limiting.

The invention consists of the forgoing and also envisages constructions of which the following gives examples.

BRIEF DESCRIPTION OF THE DRAWINGS

One preferred form of the present invention will now be described with reference to the accompanying drawings in which.

One preferred form of the invention and modifications thereof will now be described with reference to the accompanying drawings in which.

DETAILED DESCRIPTION OF PREFERRED EMBODIMENTS

Figure 1:
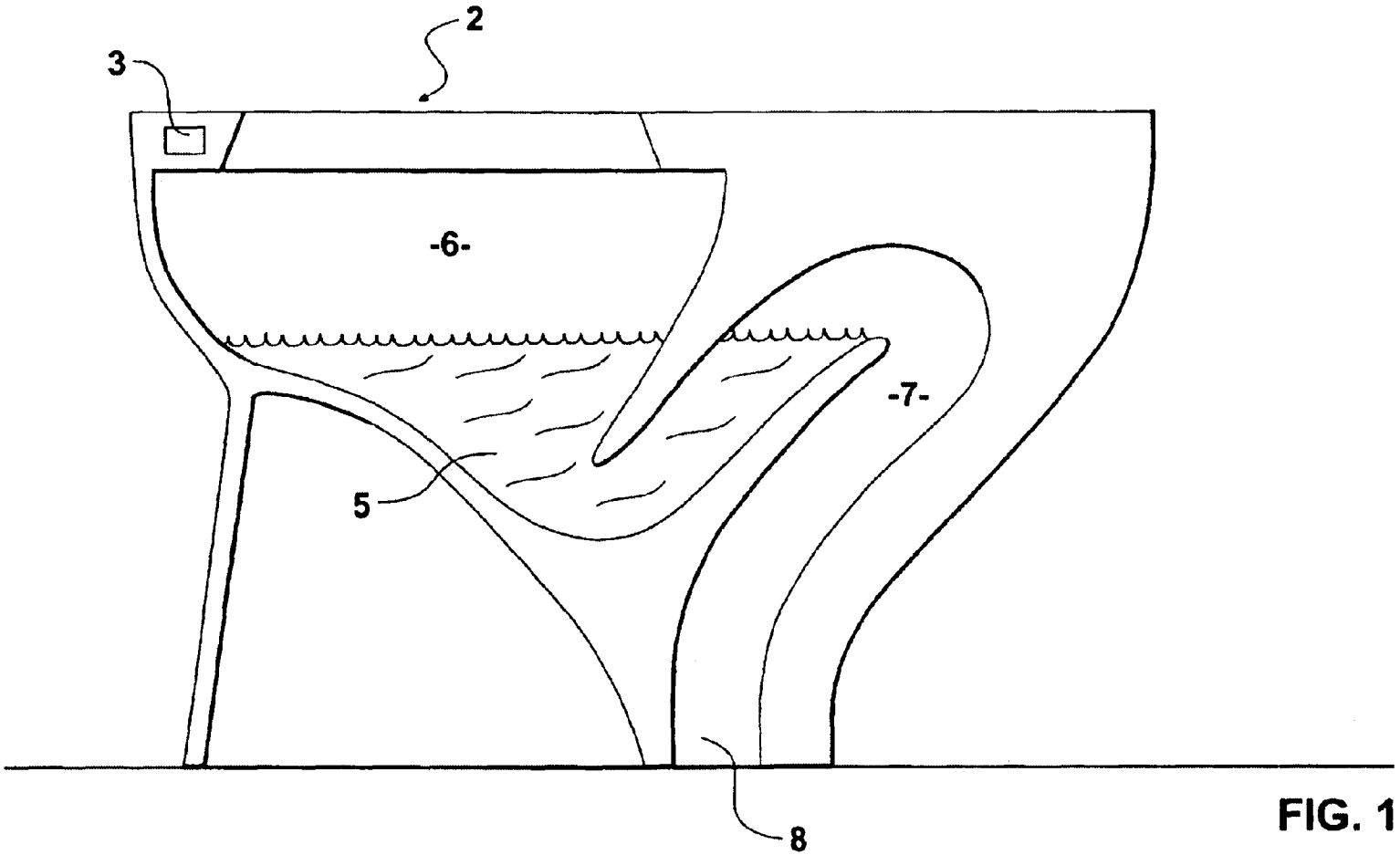
FIG. 1 is a diagrammatic side elevation in partial cross section of a toilet system including odour removal apparatus in accordance with the present invention.

Referring to FIG. 1, a toilet or lavatory is shown generally referenced 1 having a bowl or pan construction 2 about the rim 3 of which a seat will usually be provided (not shown for clarity). The pan 2 is designed to have a water trap generally referenced 5 which provides a barrier between the central part 6 of the pan and an outlet 7 from the pan. In use, outlet 7 ends in a pan outlet 8 which will usually pass through the floor (S trap type toilet) or wall (as with P trap type toilet) of the building in which the installation is provided so as to interconnect with a sewerage system, or waste-water or septic tank for example.

Figure 2:
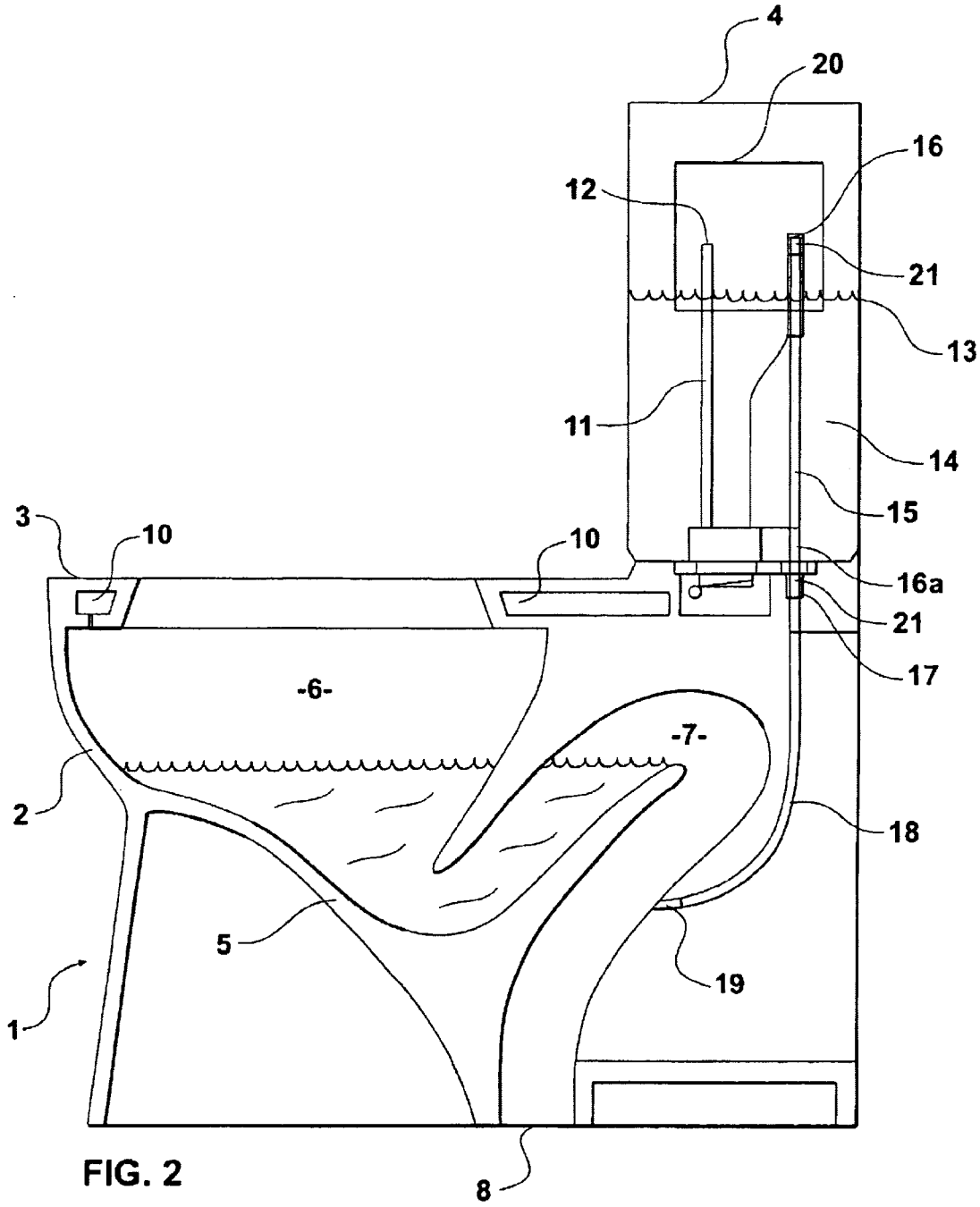
FIG. 2 is a diagrammatic side elevation in partial cross section of a practical implementation of a toilet system in accordance with FIG. 1.

As shown diagrammatically in FIG. 2, the present invention involves removal of undesirable odours in the vicinity of the bowl 6 by use of an extraction device 15 such as a fan, and delivery of the odours to the outlet 7. Since outlet 7 is on the other side of the water trap (which acts as a gas transfer barrier), the odours are effectively removed from the environment surrounding the bowl 6. To ensure that odours cannot escape from the outlet 7 through the extraction path, some form of non-return device 21 is provided in that path, for example being provided before or after the extractor 15.

Although vents are often provided in gaseous communication with toilet outlets, such vents have the purpose of preventing the water in the water trap from siphoning away through the outlet. The vents are not used for odour extraction purposes.

Turning now to FIG. 2, a diagram of a possible practical implementation of the system is shown. The pan 2 is usually moulded from an appropriate material and the mould includes appropriate apertures 10, which are in fluid communication with a cistern 4. In this way liquid such as water which is in use provided in the cistern may be distributed through the apertures in order to flush the bowl 6 and ensure that water trap 5 maintains an appropriate level of liquid.

In the example illustrated in FIG. 2, the particular toilet installation has an internal overflow conduit 11 which is in fluid communication with the flushing apertures 10 of the bowl. The overflow conduit 11 has an inlet 12 which is usually above the high water level 13 of the liquid 14 in the cistern. However, should the liquid level 13 rise to an unexpectedly high level, the liquid will enter inlet 12 and drain into the pan 6 and therefore prevent a cistern overflow situation from occurring. The provision of the inlet 12 above the usual high water level 13 of the cistern means that inlet 12 is in gaseous communication with the bowl 6.

In FIG. 2, the existing toilet installation as described above has been modified by the inclusion of extractor fan unit 15 which has an inlet 16 that is provided above the level of inlet 12. The fan unit at 15 has an outlet 16*a* which passes through the base of the cistern at an aperture 17 and is connected by an appropriate tube or conduit for example 18 to the outlet 7 through an appropriate aperture or connection 19.

Operation of the system as illustrated in FIG. 2 is as follows.

Fan unit 15 includes any device which is capable of moving gases at an acceptable rate or vacuum. Usually, the device will include a motor such as a direct current electric motor which is capable of rotating at relatively high speeds and therefore moving a fan or other propelling device connected to the motor to create the needed vacuum at the inlet of the fan unit. This creates a negative air pressure in the vicinity of inlet 16 to the fan unit. Inlet 16 is provided within an optional housing 20 the lower edge of which is provided beneath the usual high water level 13 in the cistern. This creates a closed environment between inlet 16 to the fan and outlet 12 of the internal overflow conduit so that gases may be transferred between them. Accordingly, the vacuum created by the fan creates a negative air pressure in bowl 6 relative to the surrounding environment in the room in which the toilet is located. Therefore, a gases flow occurs from the bowl 6 through the housing 20 and into the fan unit 15. From here, the gases flow continues through outlet 16*a* and through the gases flow tube 18 and into the outlet 7. Since outlet 7 is provided on the side of the water trap which is opposite the bowl 6, odours are effectively transferred from the bowl to the sewerage/septic tank side of the toilet installation. In order to ensure that gases from the outlet 7 do not return to the toilet bowl 6, a non-return valve 21 is provided anywhere in the extraction flow path. In FIG. 2, a non-return device is shown provided after the outlet 16*a* of the fan unit, and as another alternative, before the inlet to the fan. Such a non-return device may be a known valve which is purchased from a plumbing outlet for example, or may be one which is especially designed for this installation. For example, the valve may include a diaphragm or valve member which is biased to a normally closed position by a spring or by gravity for example, but which may be opened by negative air pressure at the outlet of the fan unit 15 being created in the air pressure in the pan outlet 7. The valve is lifted off the valve seal by the negative air pressure created by the fan. Therefore, when the fan 15 is not in use, the valve will return to its normally closed position to prevent any odours travelling from the outlet 7 to the pan 6.

Figure 4:
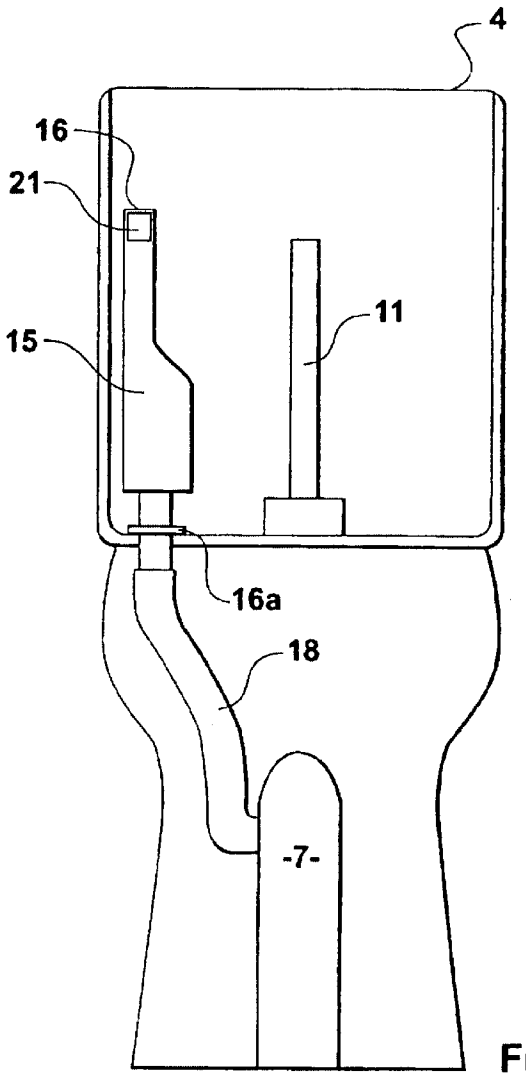
FIG. 4 is an end elevation in cross section of an alternative cistern arrangement for the cistern of FIG. 2.
Figure 3:
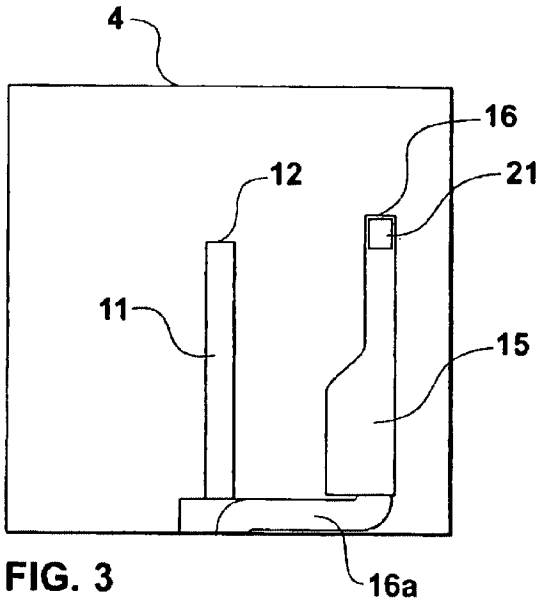
FIG. 3 is an end elevation in cross section of the cistern of FIG. 2.

Referring now to FIG. 4, the cistern is shown in end elevation. Therefore, the fan 15 may be provided at one side of the cistern (being appropriately waterproofed or otherwise provided so that the liquid in the cistern does not interfere with the motor operation) and the outlet 16 of the fan may be directed to aperture 17 which is provided in alignment with the internal overflow pipe as a convenient location for the outlet 16*a* to exit the cistern. Furthermore, as illustrated in FIG. 2, the fan inlet 16 and overflow conduit 12 do not necessarily require housing 20 to be provided over the entrance. It will be sufficient for the cistern itself to provide an appropriate housing for transfer of gases between the overflow conduit and the fan provided the cistern is sufficiently air tight.

Also, it will be appreciated that an internal overflow pipe does not need to be used to implement the present invention. Therefore, the invention may make provision for the pan 2 to include in the moulding an appropriate cavity or cavities to include the fan and the appropriate apertures for connecting the fan between the bowl 6 and the bowl outlet 7. Therefore a wide variety of arrangements is possible. For example, a specially formed aperture in the flushing assembly, or a separate new aperture provided adjacent to the bowl may be provided and the fan could be directly connected to this aperture and the fan outlet could be connected to an appropriate connector at inlet 19 provided in outlet 7 or at a point of entry to the sewerage or septic tank system which is external of the toilet assembly, if desired.

As another example, the end view of FIG. 4 clearly shows the inlet 19 to bowl outlet 7 as being provided in the form of a spigot or the like and a hose or other conduit providing the connection 18 between the fan outlet and the pan outlet 7. However, the connection at inlet 19 may be provided as a part of the pan moulding for example i.e. simply being a cavity provided in the appropriate place within the pan unit. Of course, a separate opening to the flushing apertures may be provided so that a conduit other than the internal overflow conduit may be provided within the cistern to connect directly to the fan inlet for example. However, the construction as described with reference to the figures in this example does provide an effective retro-fittable installation.

The fan unit which is used to create the air flow by making an area of relatively low pressure i.e. negative pressure with respect to ambient room pressure in the vicinity of the toilet bowl is preferably an axial flow fan which uses a DC electric motor, for example a 15 volt motor. Use of a DC motor and appropriate control mechanism such as pulse width with modulation for the power supply ensures that the motor can be speed controlled to reduce unwanted noise etc if required. Also, the motor can operate at very high rotational speeds (and thus provide an enhanced airflow) since it is not limited by supply frequency as is the case with most AC motors. Of course, since an area of relatively low pressure is provided between the fan unit and the inlet (which will usually be adjacent to the room of the toilet pan or bowl), an area of relatively high pressure i.e. pressure which is greater than or positive relevant to ambient room pressure will be created between the fan and the outlet (which in the present invention comprises the waste or sewerage outlet behind the toilet water trap).

Figure 5:
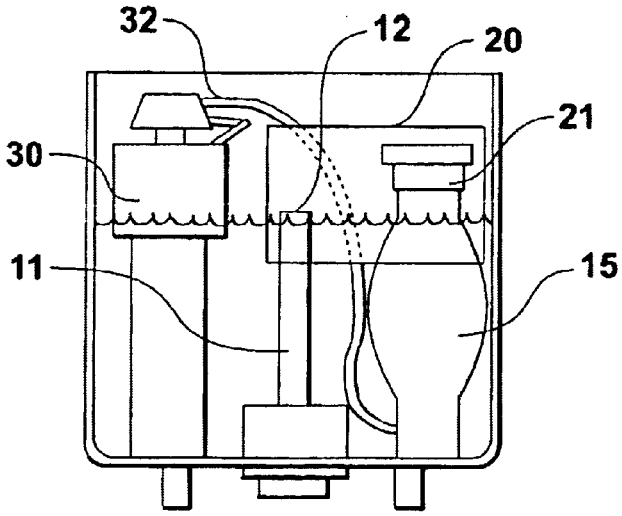
FIG. 5 is an end elevation in cross section of a further alternative sister arrangement according to the invention.

Turning now to FIG. 5, a further arrangement in the cistern is shown which is similar to the arrangement illustrated in FIG. 2. Like reference numerals indicate like features between the different drawings. Therefore, the outlet valve 11 is shown in greater detail, and in the preferred embodiment comprises a "geberit" outlet valve which has the internal overflow 12 as described in previous embodiments. The fan unit 15 is also shown and the non-return valve 21 is shown in greater detail adjacent to the inlet to the fan unit. Again, the vacuum lid 20 is illustrated. Additional features to those shown in FIG. 2 include the inlet 30 which allows liquid to enter the cistern i.e. to refill the cistern and a flexible hose 32 from the inlet 30 which is directed to the base of the cistern in order to prevent liquid entering the cistern from flowing anywhere near the inlet to the fan unit 15.

Figure 6:
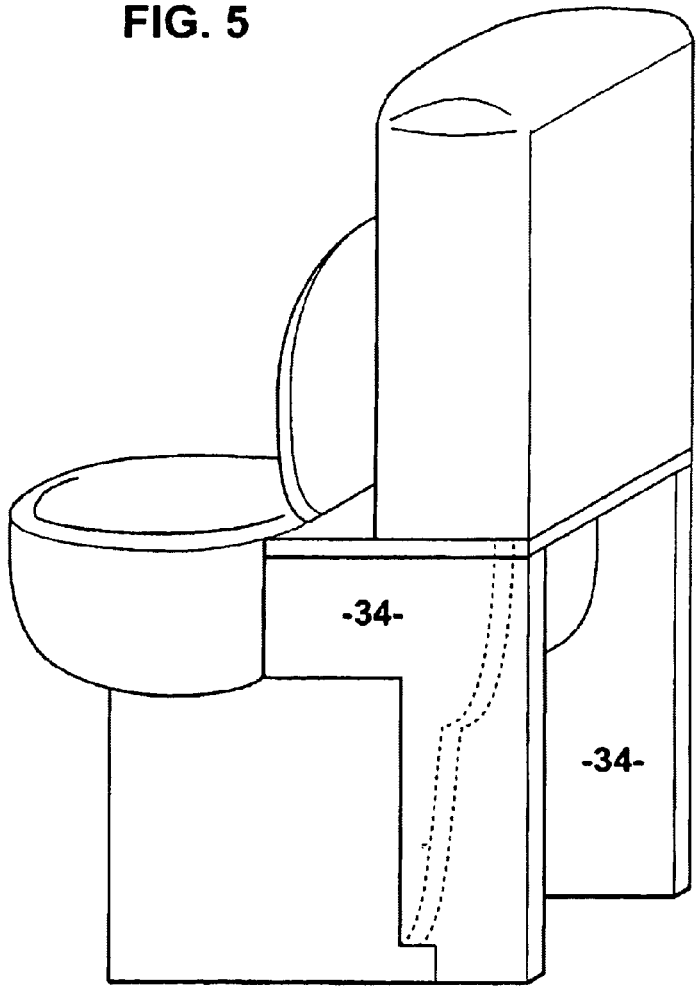
FIG. 6 is a perspective view of a pan and cistern installation wherein the pan is designed to conceal a gases flow connection.

Turning now to FIG. 6, the cistern of FIG. 5 for example may be located on a toilet bowl or pan that has extended rear side walls 34 which substantially conceal (at least from the side) a connector which may be used to provide a connection between the outlet of the fan 15 in the cistern and a waste outlet of the toilet bowl behind the water trap. Therefore, if the installation shown in FIG. 6 is mounted in a room such that the rear wall of the cistern is adjacent to a wall, the wings 34 conceal the outlet conduit.

Figure 7:
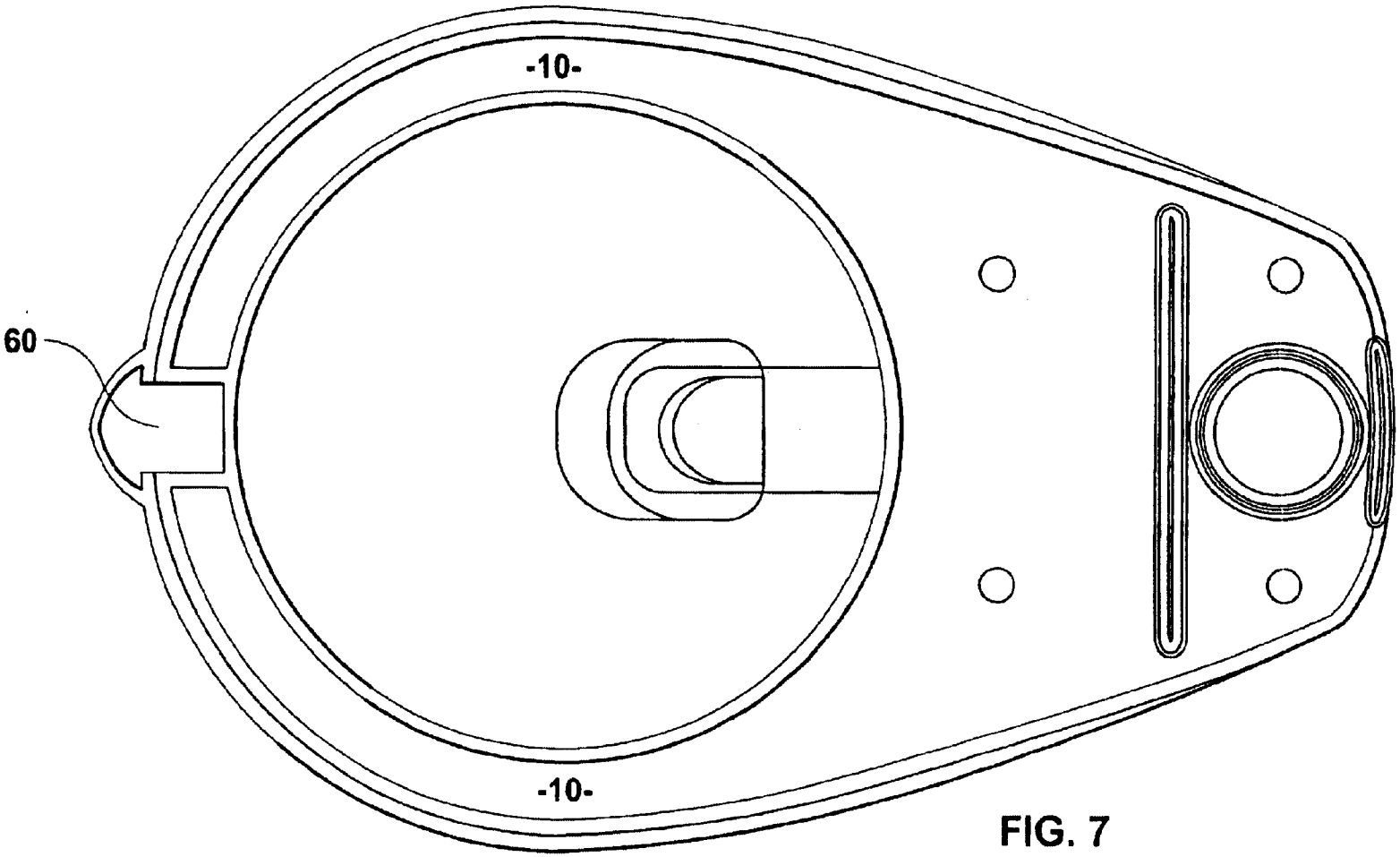
FIG. 7 is a plan view of a pan having an air inlet adjacent to the rim of the pan but at the front of the pan.

Turning now to FIG. 7, a plan view of a toilet bowl or pan is shown with the cistern removed. As described previously with reference to FIG. 2, the toilet bowl or pan typically has flushing apertures about the periphery of the bowl rim. The apertures 10 are generally illustrated in FIG. 7, but it will be seen that the bowl or pan has been moulded to provide an air inlet aperture 60 which is quite separate from flushing apertures 10. Therefore, in use water in flushing apertures 10 is diverted away from the air inlet aperture 60. Also, although air inlet aperture 60 is not specifically shown as having an inlet to the body or the pan, the inlet can be more clearly shown in the side elevation in cross section of FIG. 9. The design is such that water being flushed through apertures 10 does not enter the air inlet aperture 60, but that the air inlet aperture 60 is open to the pan so as to extract odours therefrom.

Figure 8:
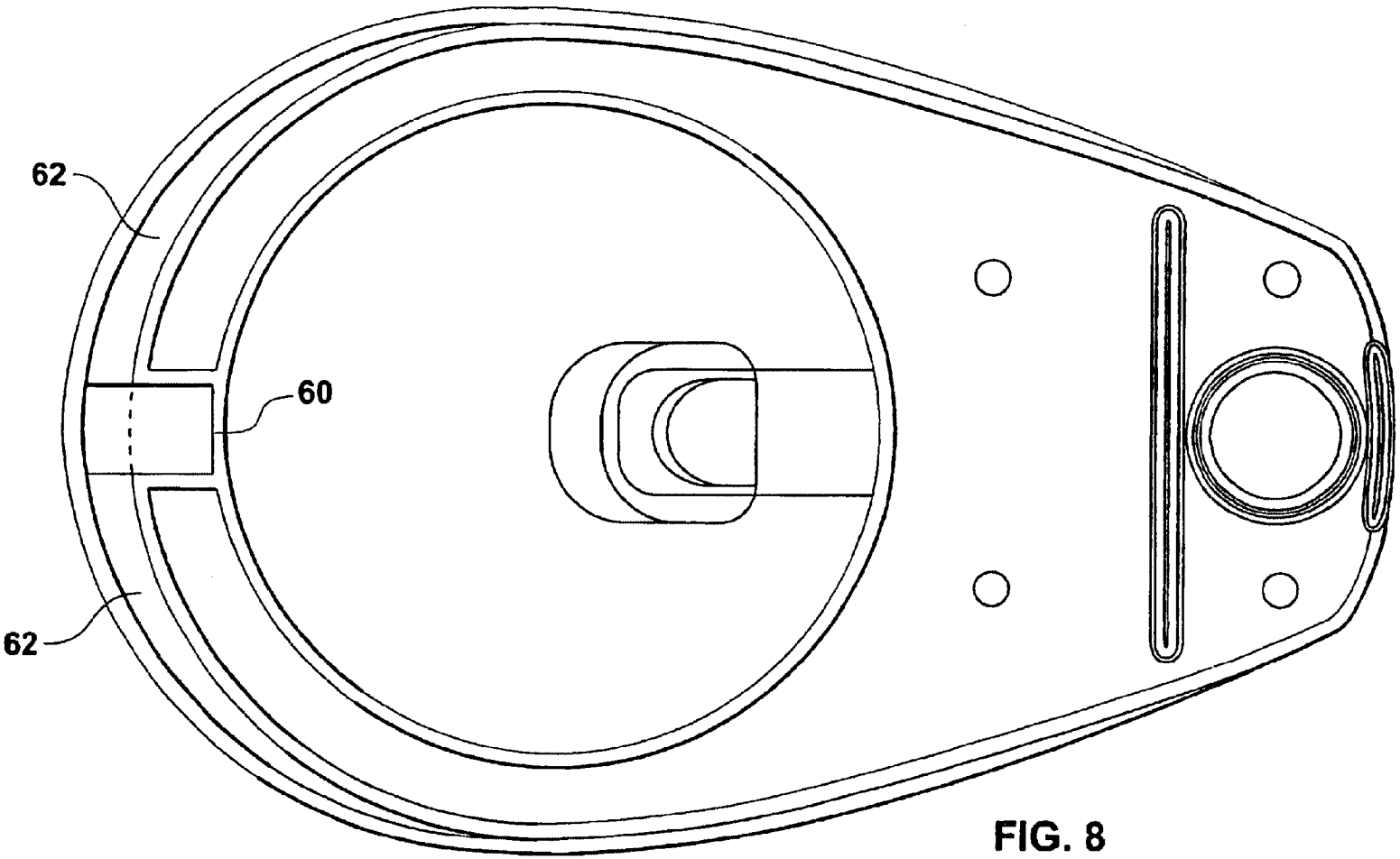
FIG. 8 is a plan view of a further arrangement of pan having an air inlet at the front of the pan.

Turning now to FIG. 8, a plan view of a pan or system is again shown having an arrangement very similar to that of FIG. 7, but there is a slightly different design of air inlet in that the pan is contoured so that the air inlet aperture 60 is again separated from the flushing apertures 10, but the air inlet has extended opening regions 62 to provide a greater area of the pan periphery through which air from the bowl can enter. Therefore, improved gases extraction is anticipated using this design.

Figure 9:
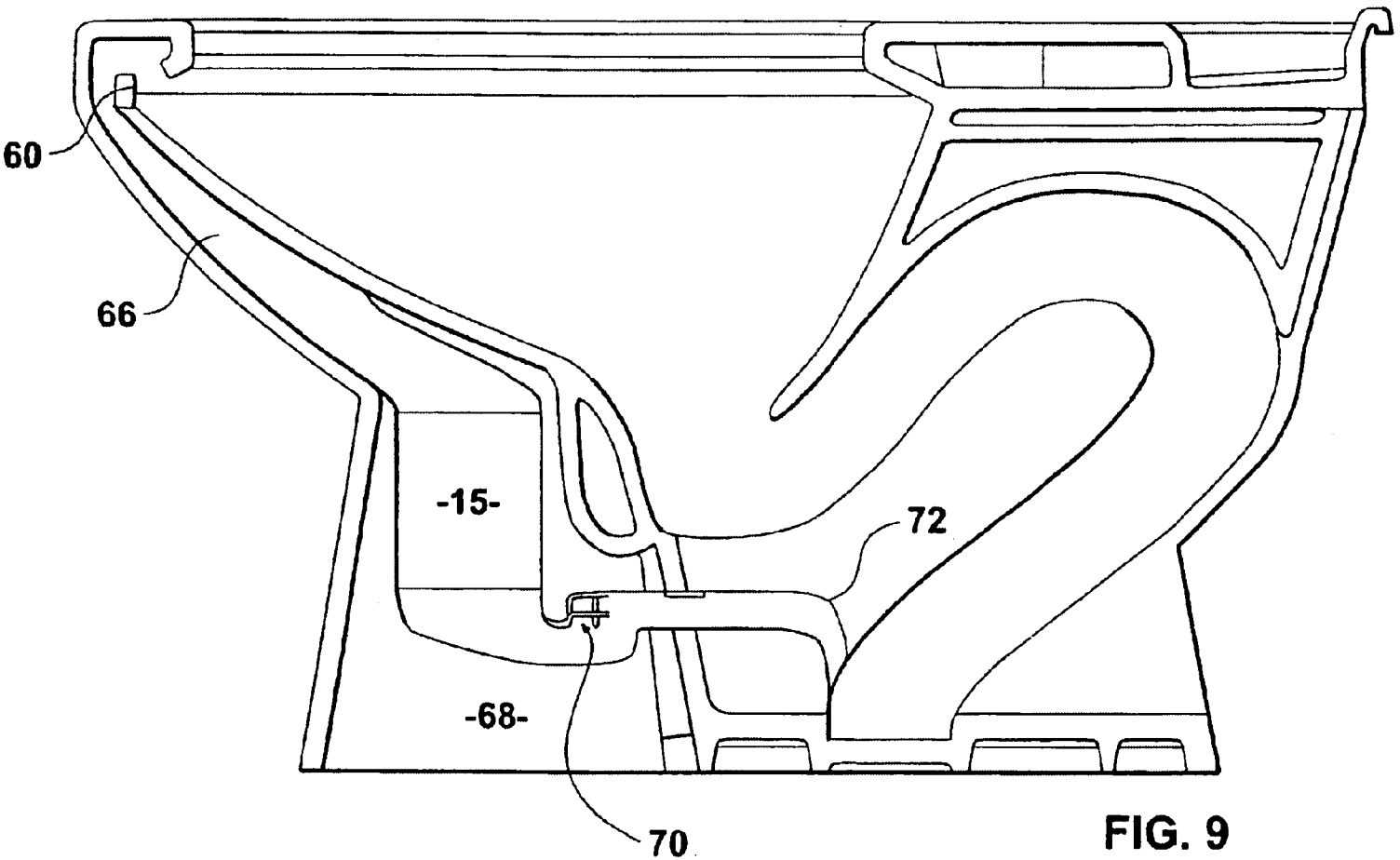
FIG. 9 is a side elevation in cross section of the pan substantially as shown in FIGS. 7 or 8 and including the gases extraction unit.

Turning now to FIG. 9, an illustration of a pan in cross section which may be used in accordance with the air inlet illustrated in the plan views of FIGS. 7 and 8 is shown. The air inlet aperture 60 includes a cavity 66 in the front wall or the pan which leads to a further enlarged concealed cavity 68 in the front of the pan unit. The fan unit 15 has an inlet which engages with cavity 66 and the fan unit itself is provided within cavity 68. The outlet from the fan has a one way air valve 70 to prevent odours escaping from behind the water trap. Further conduit 72 is provided within the pan moulding to allow gases flow between the one way valve 70 and the waste outlet of the pan behind the water trap.

Figure 10:
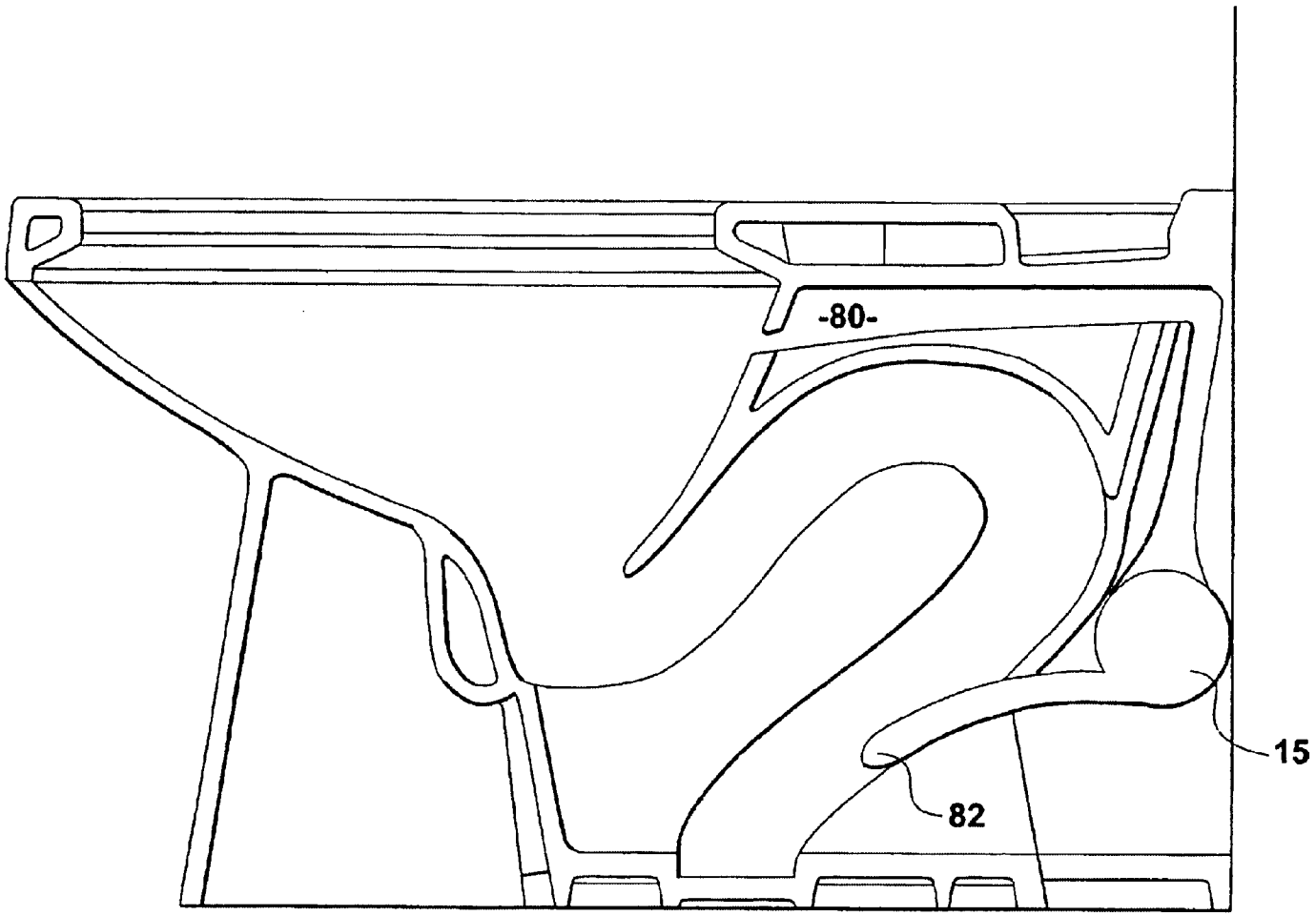
FIG. 10 is a further side elevation in cross section of the toilet pan showing another gases extraction arrangement according to the invention.

Turning now to FIG. 10, another toilet bowl or pan construction is shown in cross section having a moulded extraction cavity 80 from the rear of the pan which provides an inlet to which fan unit 15 is connected and concealed, and the waste outlet of the pan has a moulded aperture 82 to which the outlet of the fan unit 15 is connected to delivery the waste gases to the area behind the water trap. A one way air valve 70 should be situated somewhere between cavity 80 and aperture 82.

Figure 11:
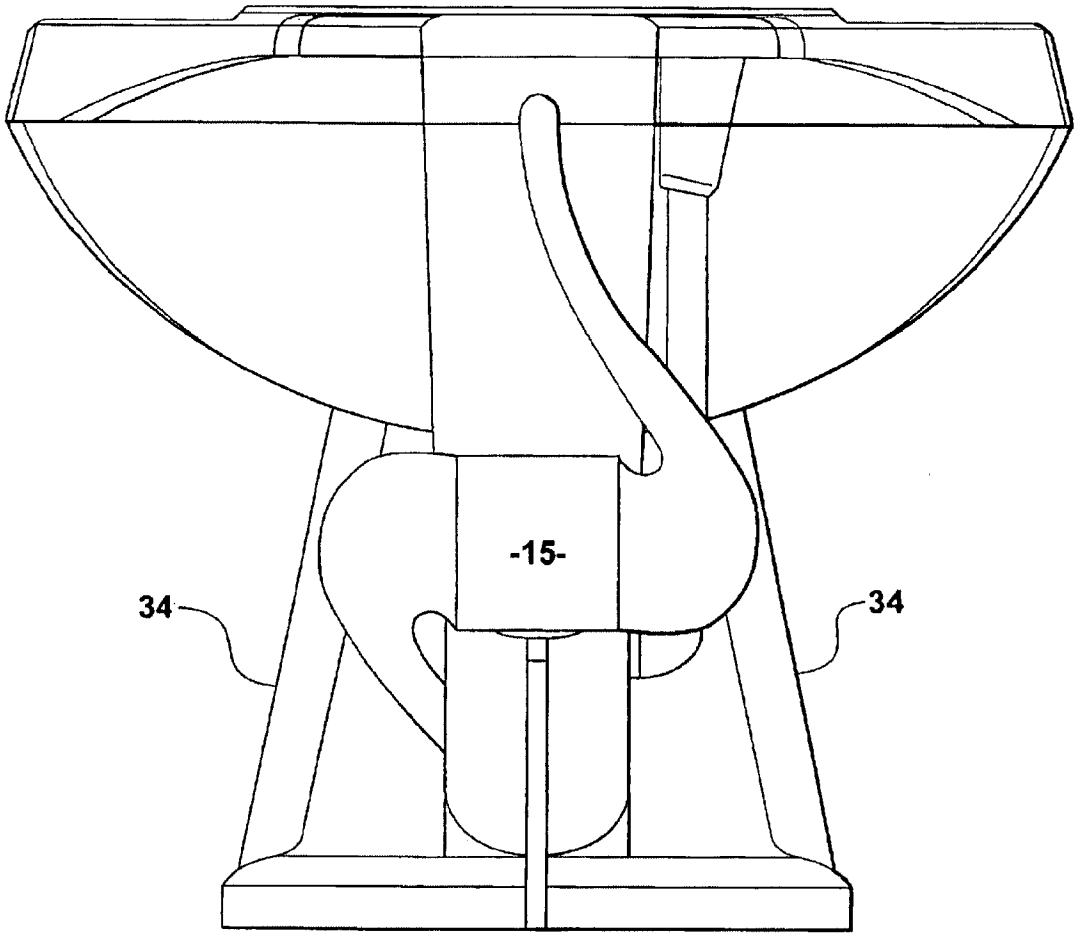
FIG. 11 is an end elevation (from the rear) of a toilet pan of FIG. 10.

Turning to FIG. 11 a rear elevation of the construction illustrated in FIG. 10 is shown. The one way air valve 70 is needed on either side of the fan to prevent reverse circulation.

Figure 12:
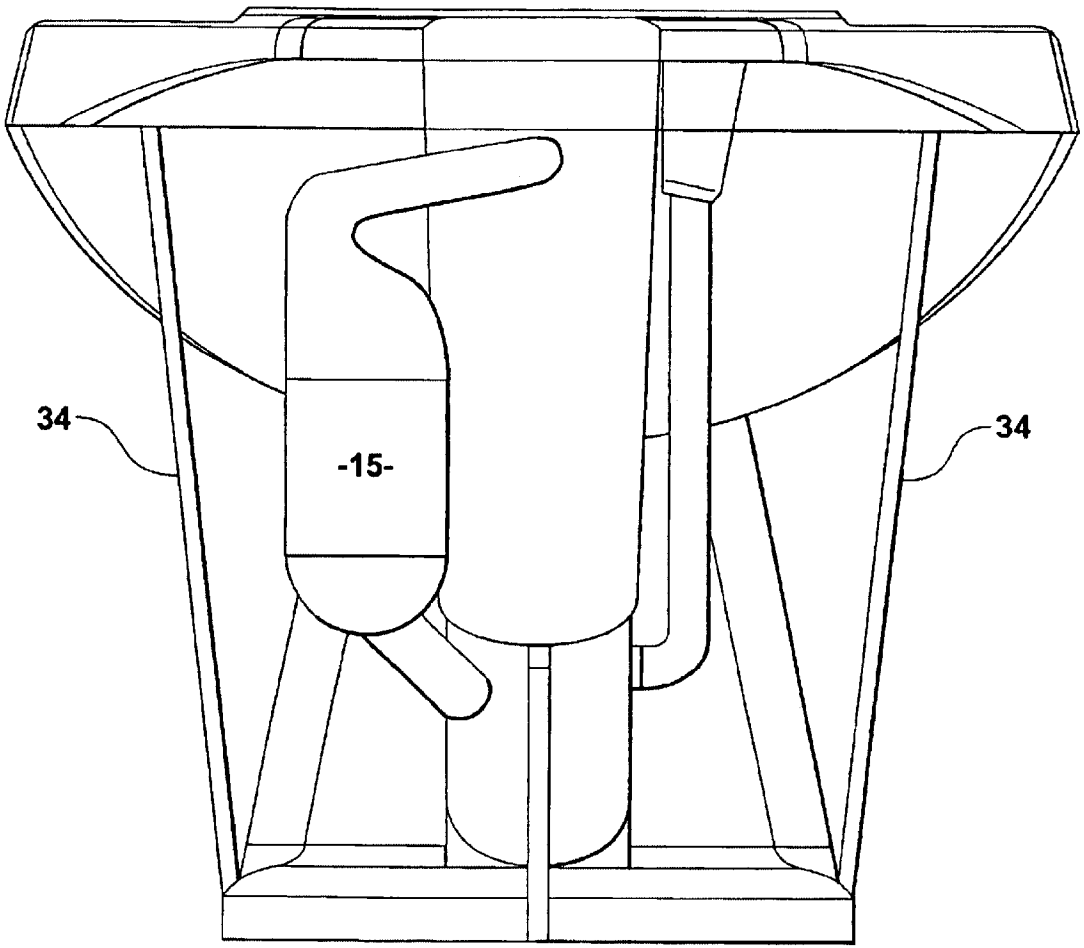
FIG. 12 shows an end elevation of toilet pan with another gas extraction arrangement and also including side walls on the pan as also diagrammatically illustrated in FIG. 6.

In FIG. 12, a vertical orientation of the fan unit (as opposed to a horizontal orientation shown in FIG. 11) is shown. This is similar to the construction illustrated in FIG. 6 however rather than the fan unit 15 being provided within the cistern, the fan is provided axially within the air extraction conduit and is concealed between side walls 34.

Therefore, from the foregoing, it will be seen that a very effective odour removal installation is achievable with this invention. In particular, the use of the water trap in the toilet as a barrier to prevent odours is highly desirable. Usually, fan installations and the like simply remove odours from the room in which the toilet installation is located and expel them to another location, such as out of the building or into a wall or ceiling cavity. The present invention provides a significant advantage that the sewerage system behind the toilet water trap, which contains foul odours in any case, is used as a disposal point for the odours in or surrounding the toilet bowl. The advantages are that; firstly odours immediately adjacent the bowl are removed before they enter the room in which the toilet is located; and secondly the odours are easily disposed of without the necessity of making further holes in the room in which the installation is located in order to deliver the odours to a location remote from the room.

Therefore, the invention provides for drawing air or gas and entrained odours from the toilet bowl/pan and discharging them to the outlet side of the toilet bowl/or pan water trap. The conveyance of the odours may be through the cistern via air ways, for example the internal overflow pipe, or through other passages such as waterways, or airways or any appropriate spaces that will bypass the cistern and/or the flush pipe and be delivered to the side of the toilet bowl pan which is on the sewerage side of the water trap. The delivery mechanism includes some form of gas extraction means such as a fan and may be implemented using hosing, tube or pipe or through appropriate spaces in the overall pan/cistern assembly. It will be seen that the extraction means may be a fan, or pulsing cistern, or pump, being mechanically operated or otherwise. The effect of making a negative air pressure within or adjacent to a toilet bowl means that the odours do not escape the toilet bowl into the room. We have found that the outlet from the fan or extraction means does not need to be connected immediately to the outlet of the bowl on the other side of the water trap, but can be connected to quite a remote area from the water trap, for example anywhere in the septic waste. In the preferred embodiment of the invention a non return valve is provided, but will be seen that other means of preventing reverse gases flowing may be employed. For example, an anti-siphon valve or similar may be used, or the fan may be operated continuously.

Finally it will be appreciated that various other alterations may be made to the foregoing without departing from the scope of this invention as set forth in the appended claims.

Throughout the description and claims of this specification the word "comprise" and variation of that word, such as "comprises" and "comprising", are not intended to exclude other additives, components, integers or steps.

What we claim is:

1. An odor removal apparatus for a toilet or lavatory, the toilet or lavatory having a bowl, an outlet from the bowl, a barrier between the bowl and the outlet which substantially prevents odors from the outlet passing to the bowl, a gas extraction means in communication with an overflow conduit in a cistern of the toilet, the gas extraction means being in communication with the outlet, whereby operation of the gas extraction means substantially removes odors from the bowl through the overflow conduit and transfers the gases to the outlet, the gas extraction means comprising a fan means including a fan comprising an impeller in the cistern operable to induce a flow of gas and entrained odors for removal of the odors from the vicinity of the toilet or lavatory, and the overflow conduit having an inlet disposed higher than the fan means, whereby the fan means is immersed in water in the cistern.

2. An odor removal apparatus as claimed in claim 1, further comprising flow control means to prevent odors flowing from the outlet to the bowl through the gas extraction means.

3. An odor removal apparatus as claimed in claim 1, wherein the fan means includes a housing, a motor within the housing, said impeller being within the housing and coupled to the motor so that operation of the motor imparts rotational energy to the impeller.

4. An odor removal apparatus as claimed in claim 1, further comprising a flow control means to substantially prevent odors flowing from the outlet to the bowl through the gas extraction means.

5. An odor removal apparatus as claimed in claim 4, wherein the flow control means is a one-way valve.

6. An odor removal apparatus as claimed in claim 1, further comprising control means to controlling the operation of said fan.

7. An odor removal apparatus as claimed in claim 6, wherein the control means includes flow rate selection means to allow the user to vary the rate of gas flow induced by the fan means.

8. An odor removal apparatus as claimed in claim 1, the fan being housed in a housing, an outlet in the housing for attachment to a gas inlet conduit, and an outlet in the housing for attachment to a gas outlet conduit.

9. An odor removal apparatus as claimed in claim 8, wherein the outlet conduit transfers odors from the fan to outside the toilet, through the base of the cistern.

* * * * *